US009068398B2

(12) United States Patent
Van Petegem et al.

(10) Patent No.: US 9,068,398 B2
(45) Date of Patent: Jun. 30, 2015

(54) DEEPWATER COMPLETION INSTALLATION AND INTERVENTION SYSTEM

(75) Inventors: Ronald Van Petegem, Montgomery, TX (US); Kevin Quick, Plantersville, TX (US); Egill Abrahamsen, Stavanger (NO); Brian Michael Carline, Richmond, TX (US); Karsten Heidecke, Houston, TX (US); Doyle Frederick Boutwell, Jr., Houston, TX (US)

(73) Assignee: WEATHERFORD/LAMB, INC., Houston, TX (US)

( * ) Notice: Subject to any disclaimer, the term of this patent is extended or adjusted under 35 U.S.C. 154(b) by 591 days.

(21) Appl. No.: 13/149,591

(22) Filed: May 31, 2011

(65) Prior Publication Data

US 2011/0290499 A1 Dec. 1, 2011

Related U.S. Application Data

(60) Provisional application No. 61/349,673, filed on May 28, 2010.

(51) Int. Cl.
*E21B 17/01* (2006.01)
*E21B 7/124* (2006.01)
(Continued)

(52) U.S. Cl.
CPC ..... *E21B 7/124* (2013.01); *B63B 25/28* (2013.01); *B63B 35/00* (2013.01); *E21B 15/02* (2013.01);
(Continued)

(58) Field of Classification Search
CPC ... E21B 17/012; E21B 17/015; E21B 19/143; E21B 15/02; E21B 19/002; E21B 19/09; F16L 1/235
USPC ..... 166/350, 345, 346, 352, 367, 77.1, 166/77.2, 85.4; 405/158, 168.3, 169–171, 405/201, 202, 224.2, 224.3; 441/3–5, 133
See application file for complete search history.

(56) References Cited

U.S. PATENT DOCUMENTS 920,031 A 4/1909 Cuthbert
2,783,027 A * 2/1957 Gilbert ..... 175/5
(Continued)

FOREIGN PATENT DOCUMENTS

FR 2880910 A1 7/2006
GB 2147549 A 5/1985
(Continued)

OTHER PUBLICATIONS

International Search Report for International Patent Application No. PCT/US11/038399 dated Nov. 7, 2011.
(Continued)

*Primary Examiner* — Matthew Buck
(74) *Attorney, Agent, or Firm* — Patterson & Sheridan, LLP

(57) ABSTRACT

Methods and apparatus for installing deepwater completions and performing well intervention from a vessel that can perform other duties while not running completions or performing interventions. The system for installing deepwater completions and performing well intervention may comprise a surface pipe handling and deployment package including a horizontally operated rig that may also be operated in a slanted mode. Deepwater completions may be deployed from the vessel via a buoyant horizontal riser (BHR), which may be supported by a submerged buoyant tensioning system (BTS). In this manner, the cost of performing completion or intervention operations may be significantly reduced compared to such operations run from a drilling rig.

25 Claims, 13 Drawing Sheets

(51) Int. Cl.

| | |
|---|---|
| ***B63B 25/28*** | (2006.01) |
| ***B63B 35/00*** | (2006.01) |
| ***E21B 15/02*** | (2006.01) |
| ***E21B 19/00*** | (2006.01) |
| ***E21B 19/09*** | (2006.01) |
| ***E21B 19/14*** | (2006.01) |
| ***E21B 19/15*** | (2006.01) |

(52) U.S. Cl.

CPC ..... *E21B 17/012* (2013.01); *E21B 17/015* (2013.01); *E21B 19/002* (2013.01); *E21B 19/09* (2013.01); *E21B 19/143* (2013.01); *E21B 19/15* (2013.01)

(56) References Cited

U.S. PATENT DOCUMENTS

| | | | | | |
|---|---|---|---|---|---|
| 3,273,346 | A | * | 9/1966 | Delaruelle et al. | 405/166 |
| 3,363,683 | A | * | 1/1968 | Corley, Jr. et al. | 166/355 |
| 3,390,654 | A | | 7/1968 | Bromell | |
| 3,413,946 | A | * | 12/1968 | Von Schultz | 114/264 |
| 3,466,680 | A | * | 9/1969 | Schirtzinger | 441/5 |
| 3,472,034 | A | | 10/1969 | Lawrence | |
| 3,496,898 | A | | 2/1970 | Morgan | |
| 3,855,656 | A | | 12/1974 | Blenkarn | |
| 3,860,122 | A | * | 1/1975 | Cernosek | 414/732 |
| 3,872,680 | A | * | 3/1975 | Nicholson et al. | 405/168.3 |
| 3,922,992 | A | * | 12/1975 | Wilbourn | 114/230.25 |
| 4,015,435 | A | * | 4/1977 | Shaw | 405/166 |
| 4,030,311 | A | * | 6/1977 | Rafferty | 405/166 |
| 4,075,862 | A | * | 2/1978 | Ames | 405/169 |
| 4,121,529 | A | * | 10/1978 | Smith et al. | 405/171 |
| 4,127,006 | A | * | 11/1978 | Oosterkamp | 405/171 |
| 4,223,737 | A | * | 9/1980 | O'Reilly | 166/336 |
| 4,271,550 | A | * | 6/1981 | Joubert et al. | 441/133 |
| 4,364,692 | A | * | 12/1982 | Kyriakides et al. | 405/168.2 |
| 5,007,482 | A | * | 4/1991 | Forsyth et al. | 166/345 |
| 5,044,825 | A | * | 9/1991 | Kaldenbach | 405/166 |
| 5,288,253 | A | * | 2/1994 | Urdshals et al. | 441/5 |
| 5,413,434 | A | * | 5/1995 | Stenfert et al. | 405/166 |
| 5,449,252 | A | * | 9/1995 | Maloberti et al. | 405/166 |
| 5,575,590 | A | * | 11/1996 | Drost et al. | 405/166 |
| 5,671,811 | A | * | 9/1997 | Head | 166/346 |
| 5,749,676 | A | * | 5/1998 | Head | 405/171 |
| 5,778,981 | A | * | 7/1998 | Head | 166/345 |
| 5,893,682 | A | * | 4/1999 | Oliveri | 405/166 |
| 6,042,303 | A | * | 3/2000 | Head | 405/195.1 |
| 6,250,395 | B1 | * | 6/2001 | Torres | 166/382 |
| 6,390,731 | B1 | * | 5/2002 | Van Gelder | 405/166 |
| 6,415,828 | B1 | * | 7/2002 | Duggal et al. | 141/387 |
| 6,688,348 | B2 | * | 2/2004 | Fontenot | 141/387 |
| 6,752,100 | B2 | * | 6/2004 | Guinn et al. | 114/258 |
| 6,837,311 | B1 | * | 1/2005 | Sele et al. | 166/353 |
| 6,942,427 | B1 | * | 9/2005 | Srinivasan | 405/210 |
| 7,677,837 | B2 | * | 3/2010 | Pionetti et al. | 405/171 |
| 7,909,538 | B2 | * | 3/2011 | Willis et al. | 405/168.4 |
| 8,087,464 | B2 | * | 1/2012 | Rodrigues et al. | 166/339 |
| 8,186,912 | B2 | * | 5/2012 | Saint-Marcoux et al. | 405/224.2 |
| 8,517,044 | B2 | * | 8/2013 | Pollack et al. | 137/236.1 |
| 2002/0177375 | A1 | * | 11/2002 | Cottrell et al. | 441/5 |
| 2003/0170077 | A1 | | 9/2003 | Herd et al. | |
| 2007/0048093 | A1 | | 3/2007 | Bhat et al. | |
| 2008/0253842 | A1 | * | 10/2008 | Wolbers et al. | 405/169 |
| 2009/0129868 | A1 | * | 5/2009 | Millheim | 405/166 |
| 2009/0260830 | A1 | * | 10/2009 | Hansen | 166/339 |
| 2010/0047040 | A1 | * | 2/2010 | Burgess et al. | 414/137.7 |

FOREIGN PATENT DOCUMENTS

| | | | |
|---|---|---|---|
| WO | WO2006016798 | A1 | 2/2006 |
| WO | 2008042943 | A2 | 4/2008 |
| WO | 2009139636 | A1 | 11/2009 |

OTHER PUBLICATIONS

PCT Invitation to Pay Additional Fees of International Application No. PCT/US2011/038399.

* cited by examiner

DEEPWATER COMPLETION INSTALLATION AND INTERVENTION SYSTEM

CROSS-REFERENCE TO RELATED APPLICATIONS

This application claims benefit of U.S. Provisional Patent Application Ser. No. 61/349,673, filed May 28, 2010, which is herein incorporated by reference.

BACKGROUND OF THE INVENTION

1. Field of the Invention

Embodiments of the present invention generally relate to methods and apparatus for installing deepwater completions and performing well intervention from a vessel that can perform other duties while not running completions or performing interventions.

2. Description of the Related Art

Deepwater completions are typically deployed from a drilling rig. As such, the drilling rig may be oversized, and it can be considered costly to deploy the completion portion of the well or to perform intervention operations. Standard completion operations generally comprise wellbore clean-up, installation of the sand face (or lower) completion, installation of the upper completion, and/or a clean-up flow period. Intervention operations typically comprise repairing, stimulating, and/or enhancing a well. Accordingly, techniques and systems to free up the high-cost drilling rig from completion and/or intervention operations are desirable.

SUMMARY OF THE INVENTION

Embodiments of the invention generally relate to methods and apparatus for installing and retrieving a completion and/or performing well intervention from a vessel that may perform other duties while not running completions or performing interventions.

One embodiment of the present invention is a method of deploying, from a vessel, apparatus for hydrocarbon operations. The method generally includes operating a rig disposed on the vessel at a less than vertical angle with respect to a deck of the vessel and deploying the apparatus from the vessel via the rig.

Another embodiment of the present invention provides a buoyant tensioning system (BTS) for deploying and retrieving subsea components from a wellhead. The BTS generally includes a frame, one or more buoys coupled to the frame, and an apparatus for coupling the frame to the wellhead.

Yet another embodiment of the present invention provides a vessel. The vessel generally includes a deck and a rig configured to deploy apparatus for subsea operations at a less than vertical angle with respect to the deck.

Yet another embodiment of the present invention provides a system. The system generally includes a vessel for deploying apparatus for subsea operations at a less than vertical angle with respect to a deck of the vessel, a BTS for coupling to a subsea wellhead, and a buoyant horizontal riser (BHR) coupled between the BTS and the vessel for routing the apparatus between the vessel and the wellhead.

BRIEF DESCRIPTION OF THE DRAWINGS

So that the manner in which the above-recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Embodiments of the present invention generally relate to installing and retrieving a completion and/or performing well intervention from a vessel that may perform other duties while not running completions or performing interventions. In this manner, the cost to perform completion or intervention operations may be significantly reduced.

Standard completion operations comprise wellbore clean-up, installation of the sand face (or lower) completion, installation of the upper completion, and clean-up flow period. Intervention operations typically comprise repairing, stimulating, and/or enhancing a well. In order to free up the high-cost drilling rig from some completion operations, operators may consider having the drilling rig still perform wellbore clean-up and installation of the lower completion, but deploying the upper completion with a vessel. For some embodiments, the vessel may be a non-dedicated vessel, wherein the non-dedicated vessel may perform other duties while not running completions or performing interventions. For some embodiments, the vessel may be a lightweight deepwater intervention, workover, and stimulation vessel. The clean-up flow period may be offloaded to the production unit. For some embodiments, operators may consider deploying the lower completion with vessel, as well.

An Exemplary Deepwater Completion Installation/Intervention System

Figure 1A:
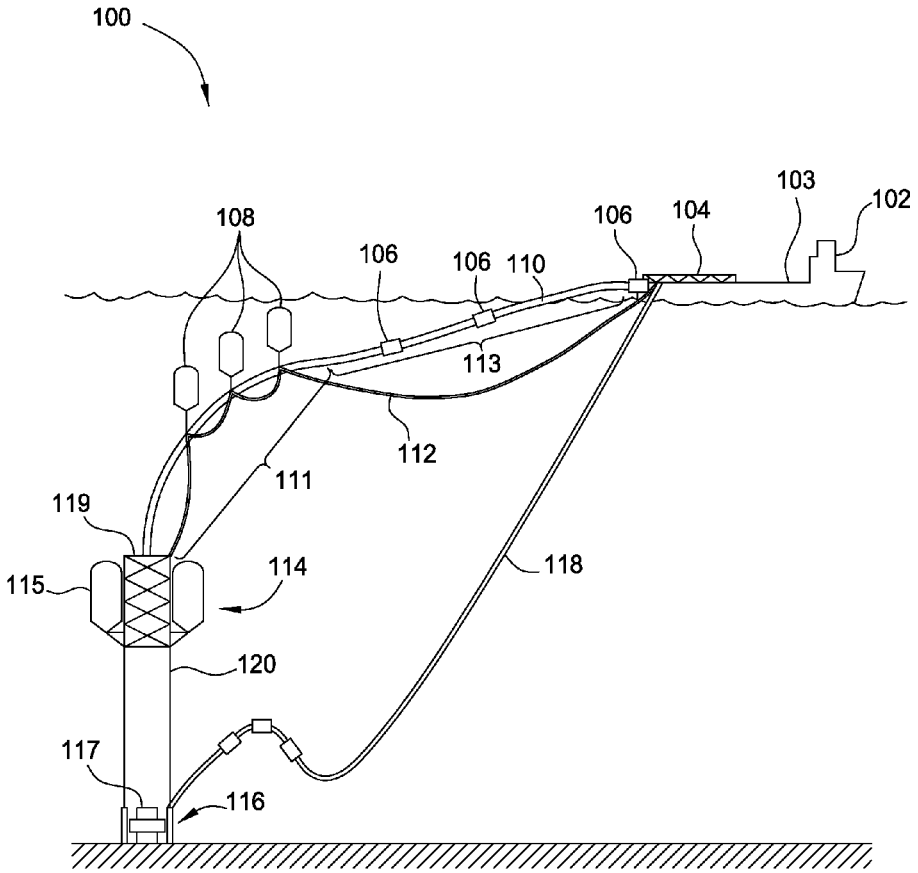
FIG. 1*a* illustrates a deepwater completion installation and intervention system installed on a vessel in a riser-less completion mode, according to an embodiment of the present invention.

FIG. 1*a* illustrates a schematic overview of a deepwater completion installation and intervention system 100 in a riser-less completion mode (e.g., in open water), in accordance with an embodiment of the present invention. The system 100 may comprise a vessel 102 and a surface pipe handling and deployment package including a horizontally operated rig 104 that may also be operated in a slanted mode with respect to the deck 103 of the vessel. To address load and tension forces, the system 100 may include a submerged buoyant tensioning system (BTS) 114. This BTS 114 may also provide the support/connection point for a buoyant horizontal riser (BHR) 110. The BHR 110 may comprise a straight section 113 and a curved section 111. This BHR 110 may then be extended horizontally and coupled to the vessel 102. Motion compensation (e.g., heave compensation) may be achieved by allowing for the majority of the vertical motion to be absorbed in the BHR 110 supported by flex joints 106. The elimination of an active motion compensation system (comprising, for example, drill string compensators) and the off-loading of most major loads to buoyant load support systems may allow the system to be deployed from a relatively small vessel 102. The system 100 may function in a water depth, for example, from about 750 to 8,000 feet.

The horizontal/slanted rig 104 may normally be operated in the horizontal mode. In this mode, the rig 104 may allow pipe to be fed from fore to aft on the vessel 102 (e.g., from the bow to the stern), or vice versa. For some embodiments, the rig 104 may allow pipe to be fed from port to starboard on the vessel 102, or vice versa. For some embodiments, the completion tubing and components may be made up with a bucking unit and torque-turn system while the rig 104 is operated in either the horizontal or the slanted mode. After a connection is made, hydraulic draw-works may move the pipe into the BHR 110. The slanted mode may be used during the deployment of the blowout preventer (BOP) 117 and buoyant tensioning system (BTS) 114. In the slanted mode, the pipe may be fed from the bottom of the rig 104 and made up in the slanted rig 104.

The BTS 114 is a submerged buoyant system having a frame 119 that may be equipped with one or more of various suitable buoys 115, such as Kevlar®-based inflatable buoys. The buoys may help the BTS 114 support the load of the BHR 110 and tubing or other apparatus deployed via the BHR 110, as well as the weight of the BTS frame. For some embodiments, the buoys 115 may comprise one or more non-inflatable buoys or a combination of both inflatable and non-inflatable buoys. The buoys 115 may comprise ring buoys, U-buoys, or any suitable shape. The inflation and deflation of these buoys 115 may be controlled from the vessel 102 via at least one control line. For some embodiments, the degree of buoyancy may be adjusted.

FIG. 1*a* illustrates the BTS 114 with two buoys 115 in a vertical configuration with respect to the frame 119 of the BTS 114, in accordance with an embodiment of the present invention. For some embodiments, the buoys 115 may also be arranged in a horizontal or diagonal configuration (i.e., at an angle) with respect to the frame 119 of the BTS 114. For some embodiments, the buoys 115 may be arranged in any combination of angles with respect to the frame 119 (including the three configurations described above: horizontal, vertical, and diagonal).

The BTS 114 may provide approximately 630,000 lbs. of buoyancy in seawater, although this buoyancy may be dynamically adjusted such that many other possibilities may exist. The main functions of the BTS 114 may comprise: providing a submerged platform to allow deployment and retrieving of the BOP 117 and other subsea components, providing a support platform for the connection of the BHR 110, providing a secondary disconnect platform for the BHR 110, providing the tensioning and support of an optional riser, and providing a pivot point for the BHR 110.

The BHR 110 may be designed to provide a reliable transition from horizontal to vertical. The BHR 110 may be constructed from any of various suitable materials such as steel, aluminum, and/or composite materials. For some embodiments, the outside diameter of the BHR may be fourteen inches, but other diameters (e.g., larger or smaller) may also be selected. The outside diameter of the BHR 110 may be chosen to allow completion components to be deployed within the BHR 110, as well as to provide the option to deploy a smaller optional riser that may be hung-off/suspended in the BTS 114. For some embodiments, means for maintaining the position of components within the BHR 110 may be provided, wherein the BHR 110 and the components within may move together relative to the movements of the vessel 102. For example, slips may be provided within the BHR 110 to compensate the movement of the components within the BHR 110. For some embodiments, a mechanical system (e.g., a pneumatic or hydraulic system) may arrest tubular movement of the pipe relative to the vessel 102.

By design, a large portion of the completion string weight may actually be supported by the BHR 110 and as such, the vessel 102 may see mostly the tensile forces in the tubing or workstring. The BHR 110 may be equipped with several inflatable buoys 108, which may be supported by a buoyancy control umbilical 112. The number, size, and buoyancy of the buoys 108 may vary depending on the job at hand and other factors. For some embodiments, the BHR 110 may be equipped with approximately 625,000 lbs. of buoyancy in seawater, wherein the combined buoyancy between the BTS 114 and the BHR 110 may be approximately 1.55 MM lbs. With the use of the buoys 108, the rig 104 may only have to support a fraction of the weight of the BHR 110 and any work string (e.g., deployed inside the BHR 110). Therefore, the vessel 102 need not be as heavy or large as a vessel supporting the BHR 110 without the buoys 108.

Figure 1B:
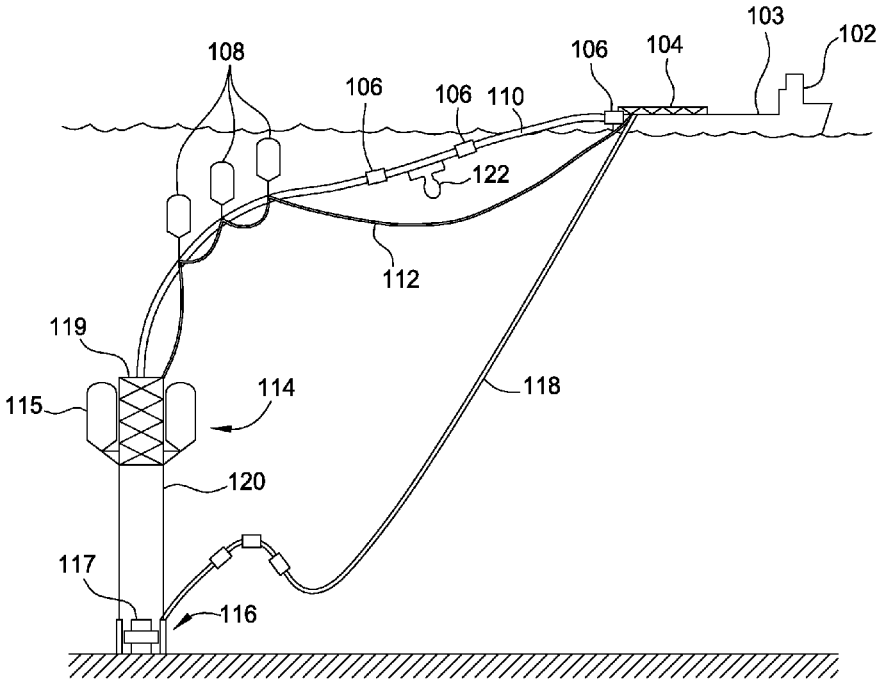
FIGS. 1*b* and 1*c* illustrate techniques for preventing bowing of a buoyant horizontal riser (BHR), according to embodiments of the present invention.
Figure 1C:
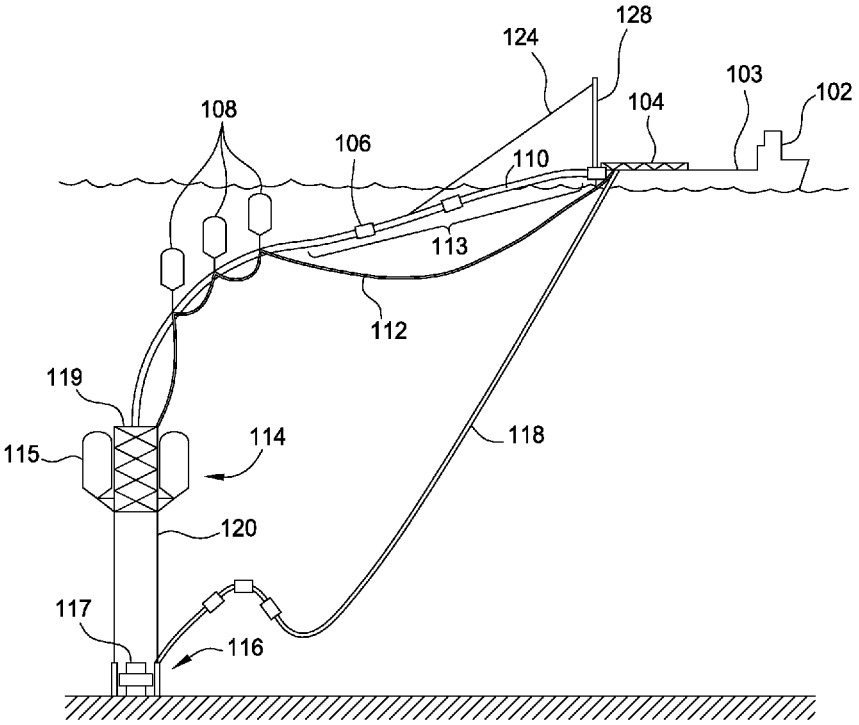

For some embodiments, the straight section 113 of the BHR 110 may comprise additional means to prevent, or at least reduce, substantial bowing of the BHR 110. FIG. 1*b* illustrates an additional buoy 122 on the underside of the BHR, wherein the buoy 122 pushes the BHR 110 in an upward direction in an effort to prevent bowing, in accordance with an embodiment of the present invention. Some embodiments may include multiple additional buoys 122. For some embodiments, bowing of the BHR 110 may be prevented, or at least reduced, with the addition of one or more buoys above the BHR 110 between the buoys 108 and the vessel 102, or any combination of buoys above, below, or to the side of the BHR 110. The one or more additional buoys 122 may have as small a lateral surface area as possible to reduce pressure on and lateral movement of the BHR 110 due to water currents. For other embodiments, the straight section 113 of the BHR 110 may be held up by a tension cable 124, as illustrated in FIG. 1*c*. The tension cable 124 may be supported by a mast 128 (or a spar), which may be located aft on the vessel 102.

The curved portion 111 of the BHR 110 may be designed around a single 400 feet radius (15°/100 feet dogleg) but other radius designs with lower drop rates including multiple radius configurations are possible. For some embodiments, to establish the curve, strategically placed buoys (e.g., buoys 108) and the weight of the pipe may be used to create the curved portion 111. This may allow for a very simple make up and the use of almost standard pipe. For some embodiments, to establish the curved portion 111, pre-bend risers with a special clamp-type connection may be used. The benefit of this system may be the reduction of stress in the curved section and a more predictable friction/load distribution.

The main functions of the BHR 110 may include providing a transition conduit from vertical to horizontal, providing a motion compensation system, providing the compensation for the pitch and roll of the vessel 102, absorbing lateral loads, providing an emergency disconnect system, supporting the bulk of the completion weight, accommodating running of the optional sub-sea riser, and providing additional tension for the BTS 114.

Tension cables 120 may be designed to provide a lightweight, but strong connection between the BTS 114 and the wellhead 116. The tension cables may comprise any of various suitable materials that are strong, yet lightweight, such as steel, Kevlar®, Spectra®, Vectran®, Zylon®, Dyneema®, Technora®, Twaron®, plasma, or any aramid-type fiber. Some of these materials may exist in combination with each other. For some embodiments, the system may comprise two or more 3-inch-diameter cables 120, but the length of the tension cables 120 may vary. Each tension cable 120 may provide about 600 klbs. of break strength. The diameter and break strength of the tension cables 120 may vary depending on strength requirements for any one or all specific jobs. The combined weight of the cables (2×7,000 feet deployed) may be approximately 34,000 lbs. in air.

Additional mechanical barriers may be installed in the wellbore, which may be activated (i.e., opened) after the well is completed and the Christmas tree (i.e., on the wellhead 116) is installed. In case of a malfunction, an intervention may be performed. There may a requirement to leave the well with an environmentally acceptable fluid that is compatible with seawater. This fluid may be displaced into the sea while running in with the completion. It may be difficult to circulate with returns while the completion is run. This is mainly due to the control lines preventing the use of pipe rams or even an annular preventer. The same may be true for reverse circulating.

Figure 1D:
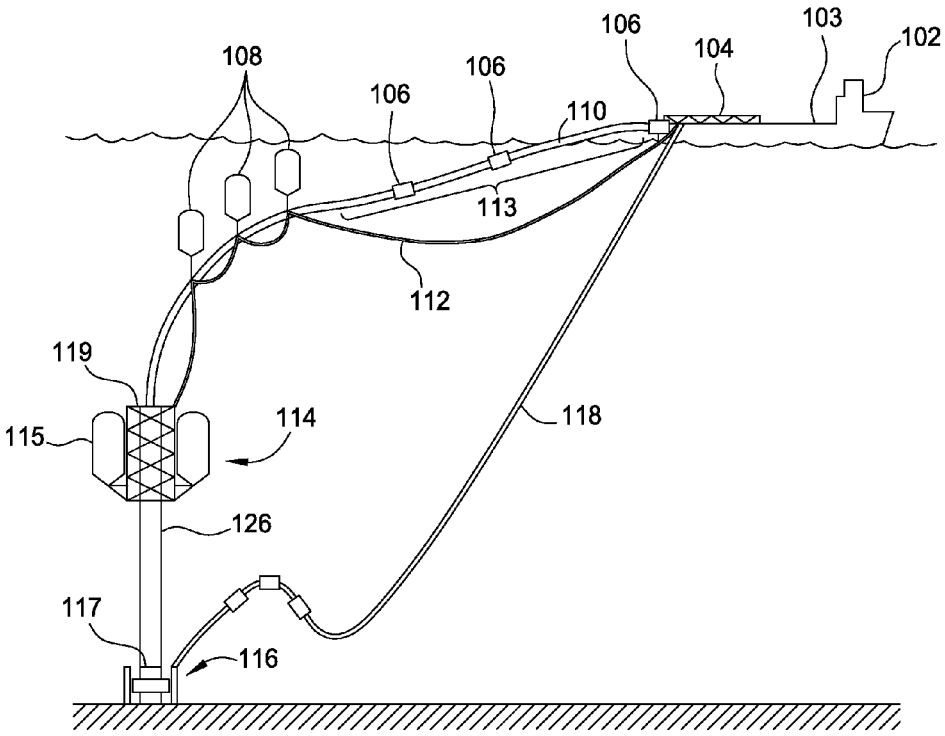
FIG. 1*d* illustrates a deepwater completion installation and intervention system installed on a vessel with a completion riser, according to an embodiment of the present invention.

Therefore, for some embodiments, rather than tension cables 120, a riser 126 may provide a connection between the BTS 114 and the wellhead 116, as illustrated in FIG. 1*d*. Instead of using the tension cables 120, the system may be deployed by: running the riser 126 through the BHR 110, latching the riser 126 on to the BOP 117, lowering the riser 126 and connecting the BOP 117 to the wellhead 116, hanging the riser 126 in the BTS 114, and connecting the riser 126 to the BHR 110 to allow subsea returns. The riser 126 may be constructed from any of various suitable materials such as steel, aluminum, and/or composite materials. With this system deployed, the flexibility of the system may increase, and even lower completions and wellbore clean-up may be performed.

Figure 2:
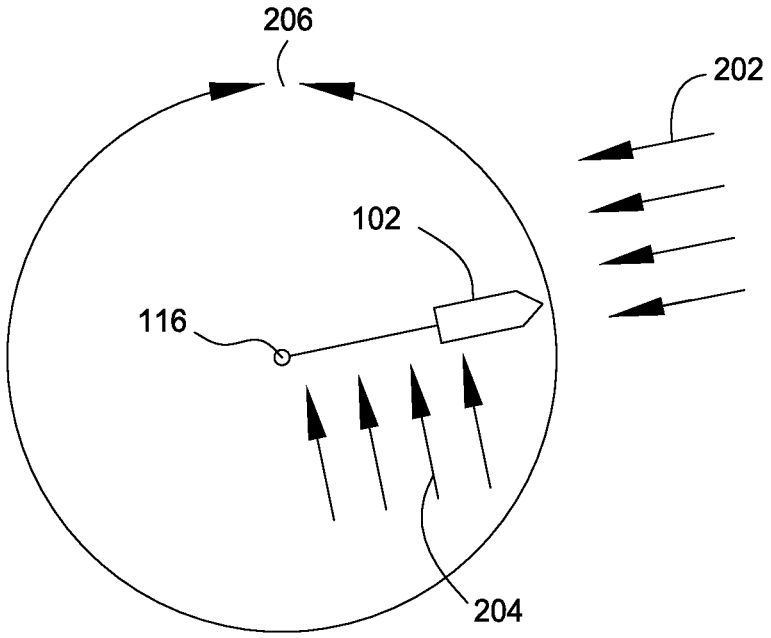
FIG. 2 illustrates a schematic view of the vessel functioning as a hybrid mooring system, according to an embodiment of the present invention.

The system may be designed to function as a hybrid mooring system, as illustrated in FIG. 2, in accordance with an embodiment of the present invention. By operating a desired distance from the wellhead 116, the vessel 102, in combination with the BTS 114, may use its main thrusters, mostly with the bow of the vessel 102 facing the effects of the wind 202, but some lateral thrust (or rear thrust combined with the vessel's rudder) may be required to compensate for current 204. In this manner, the vessel 102 may travel in an arcuate path 206 as the wind 202 and/or the current 204 shifts, as if the vessel 102 was moored to the wellhead 116.

The deepwater completion installation and intervention system may be configured to be deployed on a vessel 102 with a dynamic positioning system Class 2 (DP2) or better according to the International Maritime Organization (IMO) equipment classes. With DP2 or better, the vessel 102 may automatically maintain its position and heading (using the Global Position System (GPS) and computer control of the thrusters, for example) with redundancy, such that the failure of any single component should not cause loss of position.

Figure 3:
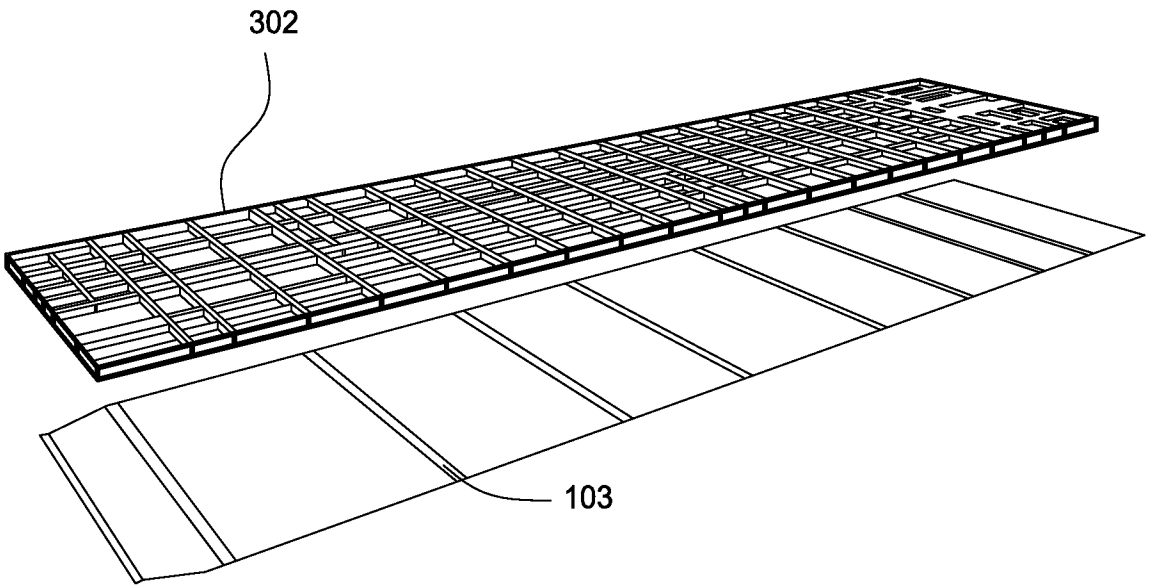
FIG. 3 illustrates a purpose-designed grid that may be deployed on the vessel, according to an embodiment of the present invention.

On top of the deck 103, a purpose-designed grid 302 may be deployed as depicted in FIG. 3, in accordance with an embodiment of the present invention. The grid 302 may comprise beams of any suitably strong material, such as steel. The grid 302 may be connected with the vessel's deck or deck beams by any suitable means, such as welding or bolting. The grid 302 may be laid out in such a way that all the rig equipment may be put in a pre-designated location and locked in place with standard International Organization for Standardization (ISO) container latches or another secure and approved way.

The minimum free deck space involved may be, for example, about 230×55 feet. This deck space minimum may be mainly for installations of upper completions and may be reduced in case of subsea coiled tubing or wireline interventions.

After the grid 302 is in place, all the desired hydraulic hoses, electric cables, fluid hoses, piping, and/or high-pressure pump lines may be run and laid out through pre-existing spaces cut out in the "H" beams of the grid, for some embodiments. This may allow most connections to be "hidden" under the elevated deck space. After at least some, if not all, of the hoses and cables are in place, the rig equipment may be installed with each piece of equipment in its own designated area. With all the equipment in place, the hydraulic, electrical, and pumping connections may be made, a system test may be performed, and all equipment may be function tested. After the successful testing of the system, the pipe handling system may be loaded with the desired tubular completion components.

The BTS 114 with the BOP stack 117 attached may be placed on top of the rig 104, and the first joint of the BHR 110 may be attached to the BTS 114. Connections may be made, and the tension cables 120 may be run through the guideposts of the BTS 114 and BOP stack 117. At this point, the vessel 102 may be ready to leave the dock and travel to the location of the wellhead 116.

An Exemplary Deck Layout

Figure 4:
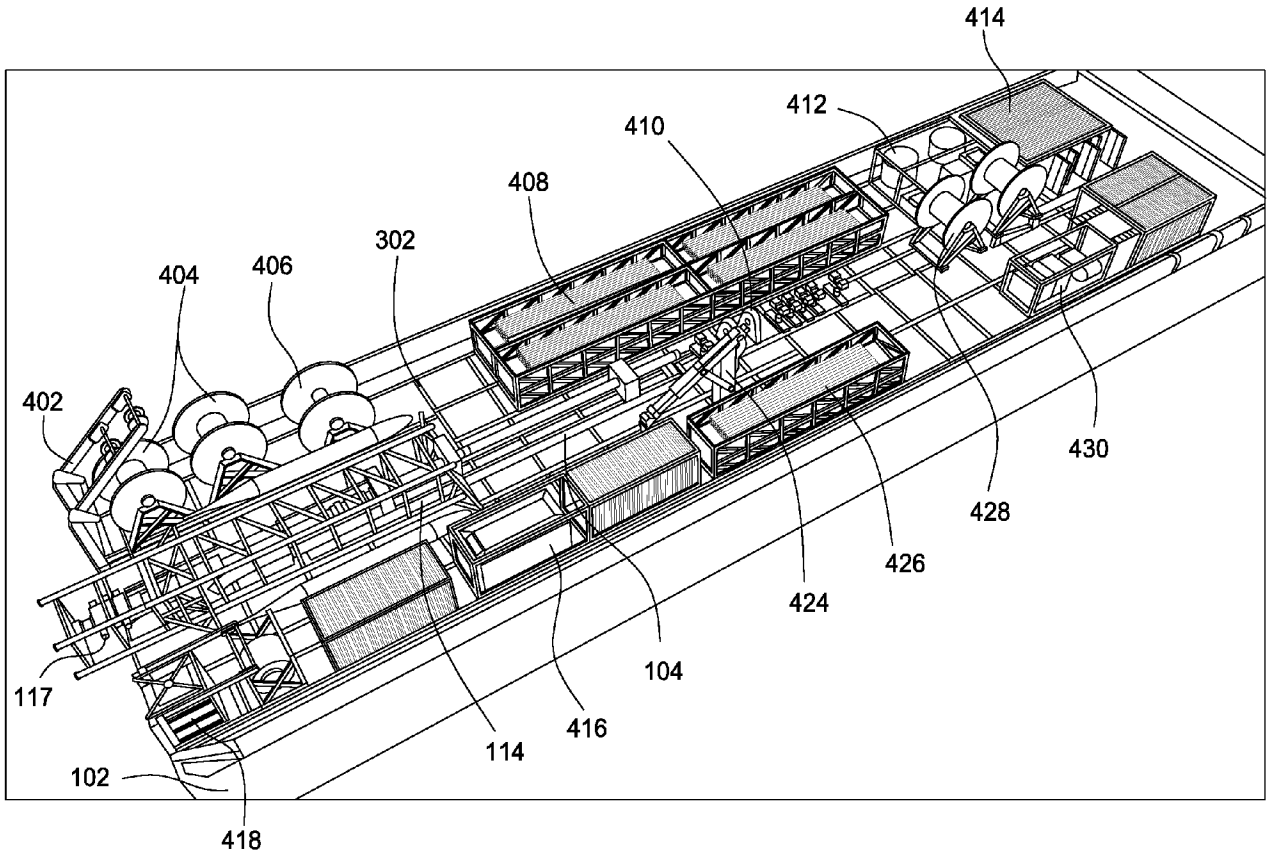
FIG. 4 illustrates an overview of a layout of the major components that may be found on the vessel ready to be deployed, according to an embodiment of the present invention.

FIG. 4 illustrates an exemplary layout of the major components and the vessel 102 ready to deploy the BTS 114 with the BOP 117, in accordance with an embodiment of the present invention. All lifting equipment may be DET NORSKE VERITAS (DNV) 2.7-1 certified, and all diesel engines may be tier 3 or better.

An umbilical handler 402 may be an "A" frame type crane with room to deploy one or more items, e.g., two umbilicals and possibly two annular return/choke/kill lines. The umbilical handler 402 may be used to keep the umbilicals/flexible risers away from the hull of the vessel 102. Alternatively, and depending on the vessel 102, the umbilicals may be deployed directly from a gooseneck/stand-off device mounted on the spooler frame and over the port or starboard side of the vessel 102.

There may be two or more spools 404 intended for umbilicals: at least one umbilical 118 for the BOP 117 and other subsea components, and at least one for the buoyancy control umbilical 112 for both the BTS 114 and the BHR 110. Both spools 404 may be designed and sized to handle up to about 9,000 feet of 3-inch-diameter umbilical. Additional spools to manage a flexible riser may also be installed.

A flatpack spool 406 may be designed to handle a five-line (e.g., 3×¼, 1×⅜, 1×⅝ inches)×10,000 feet flatpack. As used herein, a flatpack generally refers to an encapsulated set of data and/or control lines to link downhole tools to surface equipment, wherein the lines may be hydraulic, electrical, or fiber optic lines, for example. Alternatively, two smaller spools with fewer lines per flatpack may also be installed.

Central components of a pipe handling system 408 and a tubing make-up system 410 may comprise components for moving pipe from a top pipe layer to an elevator system, wherein the elevator system may lower the pipe from the top pipe layer to a pipe transfer system. Further, the pipe transfer system may be in line with the tubing string. The pipe transfer system may be programmable to different elevations accommodating various pipe sizes while securing the pipe and maintaining its center alignment with the center of the tubing make-up system 410 (i.e., bucking unit). The pipe transfer system may move the pipe joint into the center of the tubing make-up system 410 which may be capable of making up/breaking out pipes of any size, for example, from 2⅜ to 20 inches. The tubing make-up system 410 may thread the pipe joints together by screwing them together. The tubing make-up system 410 may comprise rollers, balls, or multiple belts (e.g., two belts forming a V-shape) for the pipe to move along. For some embodiments, rather than threading the pipe joints in the tubing make-up system 410, the pipe joints may be welded or fused together.

After the pipes pass through the tubing make-up system 410, control lines may be mounted on the pipe before the pipes are deployed from the vessel 102. For other embodiments, the control lines may be preinstalled on the pipe assemblies. When handling pipe assemblies with preinstalled control lines, at least some, if not all, pipe gripping apparatuses (e.g., in the rig 104 and in the tubing make-up system 410) may have areas or slots that allow passage of the control lines when the pipe assembly is made up to the completion string and the string is lowered into the well.

For some embodiments, two or more vessels may be used for the deepwater completion installation or intervention operations. For example, the rig 104 may be located on one vessel for riser, tensioning, and buoyancy system deployment, and another vessel may be used for completion string installation.

There are various embodiments for the pipe handling system 408. One embodiment comprises pipe tubs with an elevator system that may incorporate hinged arms, for example, to separate layers of pipe in the individual tubs and a gate system for ejecting the individual joints onto the pipe transfer system. As the elevator system raises the contents of the pipe tub, the upper layer of pipe may be aligned with the eject gate of the tub, and the individual joints may be allowed to exit through the gate onto the pipe transfer system. As each layer of pipe is exhausted, the hinged arms used to separate the layers of pipe may rotate out of the way via a spring-hinge mechanism, for example, to expose the next layer of pipe to the eject gate on the tub.

Figure 5A:
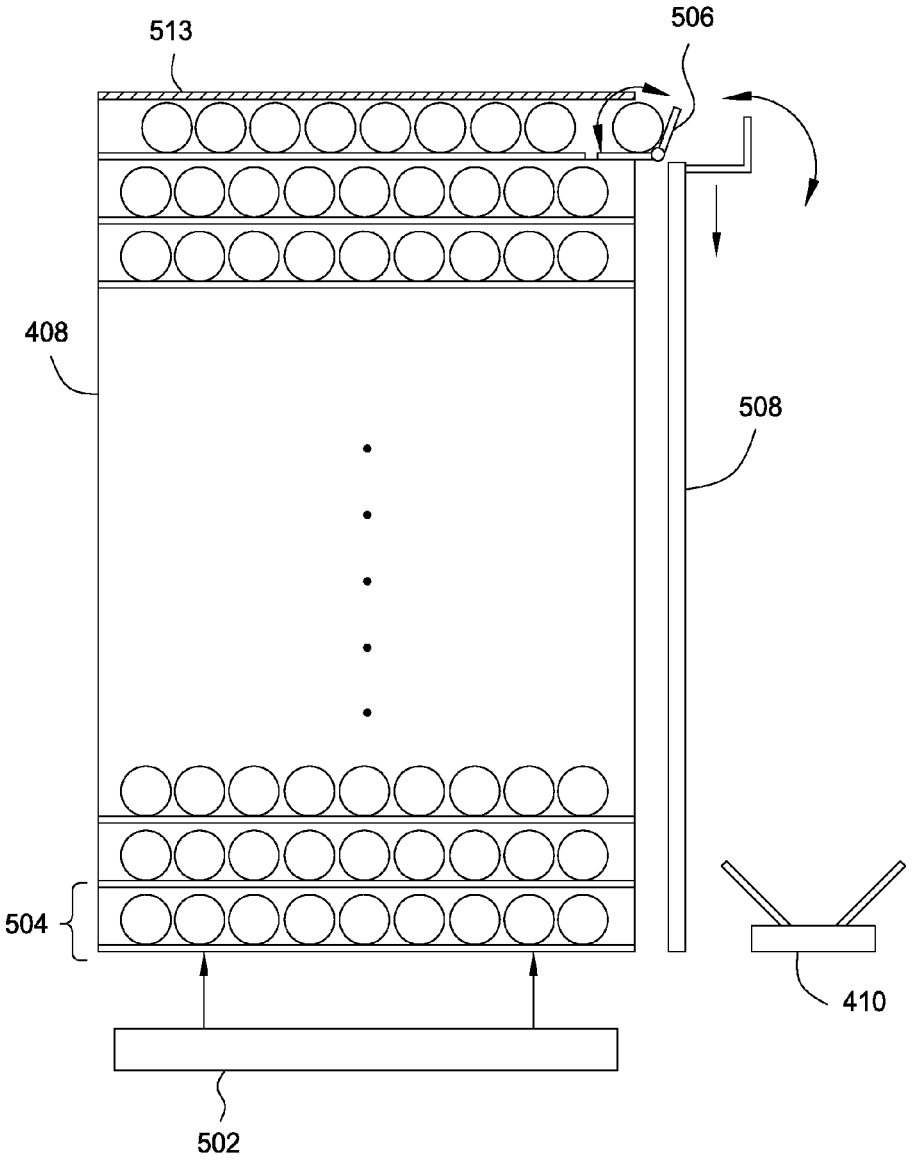
FIGS. 5*a-c* illustrate various pipe handling systems, according to embodiments of the present invention.

Another embodiment includes a pipe staging system with pipes pre-loaded into road-transportable pipe tubs, as illustrated in FIG. 5*a*. These pipe tubs, which may be part of the pipe handling system 408, may be delivered by trucks or trains, for example. The pipe tubs may be placed on the deck 103 by a crane, for example, at the dockside and may be locked into dedicated positions on the grid 302. The pipe tubs may have open slots in the bottom for a scissor type pipe-hoisting mechanism 502, for example, in the "floor structure" that raises the layers 504 of pipe upwards inside the tub. This hoisting mechanism may have sufficient power and elevation capacity to elevate the internal layers of pipe inside the stacked and secured pipe tubs. The upper portion of the pipe tub may be fitted with a feeding mechanism 513 that pushes the uppermost layer of pipe sideways to the eject gate 506 of the tub, wherein the pipe is ejected onto the pipe elevator system 508. This may secure the layer against roll due to movements of the vessel 102 while feeding the joints to the elevator system 508. The pipe elevator system 508 may move the pipe joint onto the pipe transfer system that may be in line with the tubing make-up system 410, wherein there may be horizontal movement.

Figure 5B:
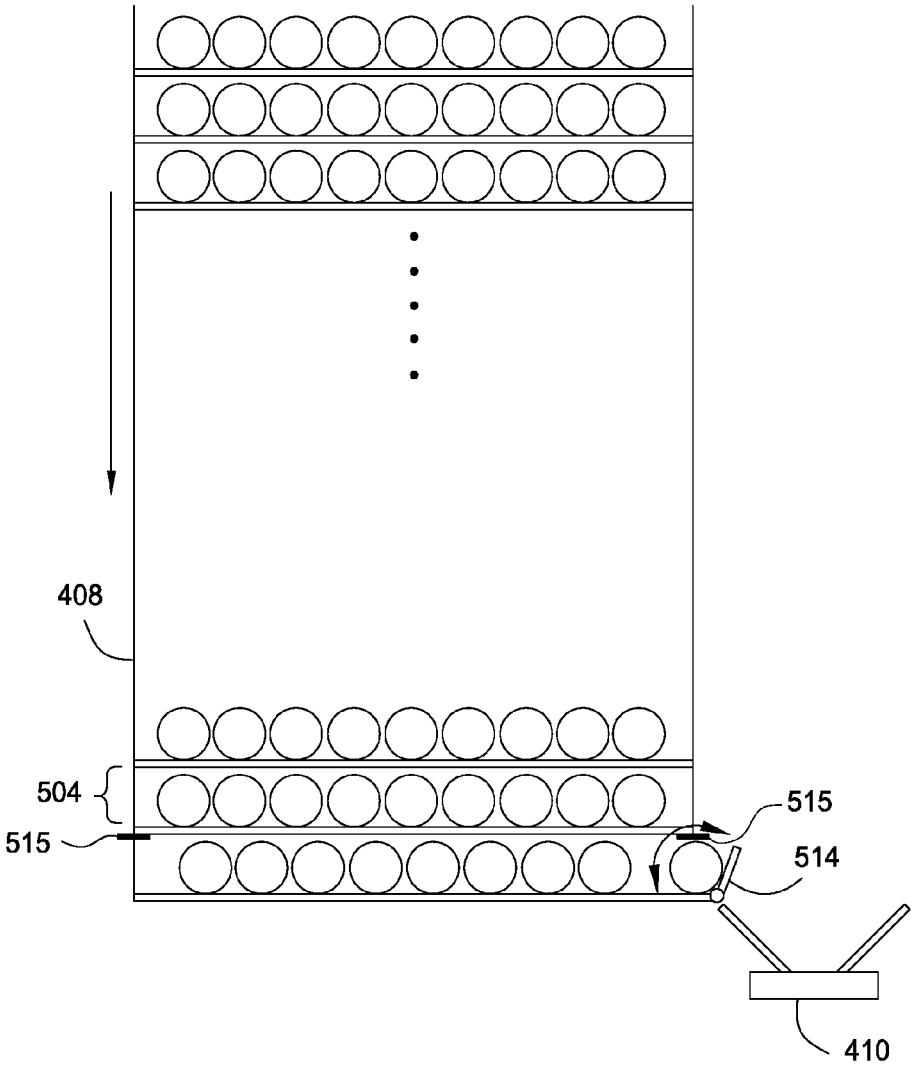

FIG. 5*b* illustrates a pipe handling system 408 wherein the pipes are ejected through a bottom layer of the pipe tub at an eject gate 514, in accordance with an embodiment of the present invention. Brackets 515 may support all layers of pipe above the bottom layer, wherein the layers may be lowered as the pipes on the bottom layer are exhausted.

Figure 5C:
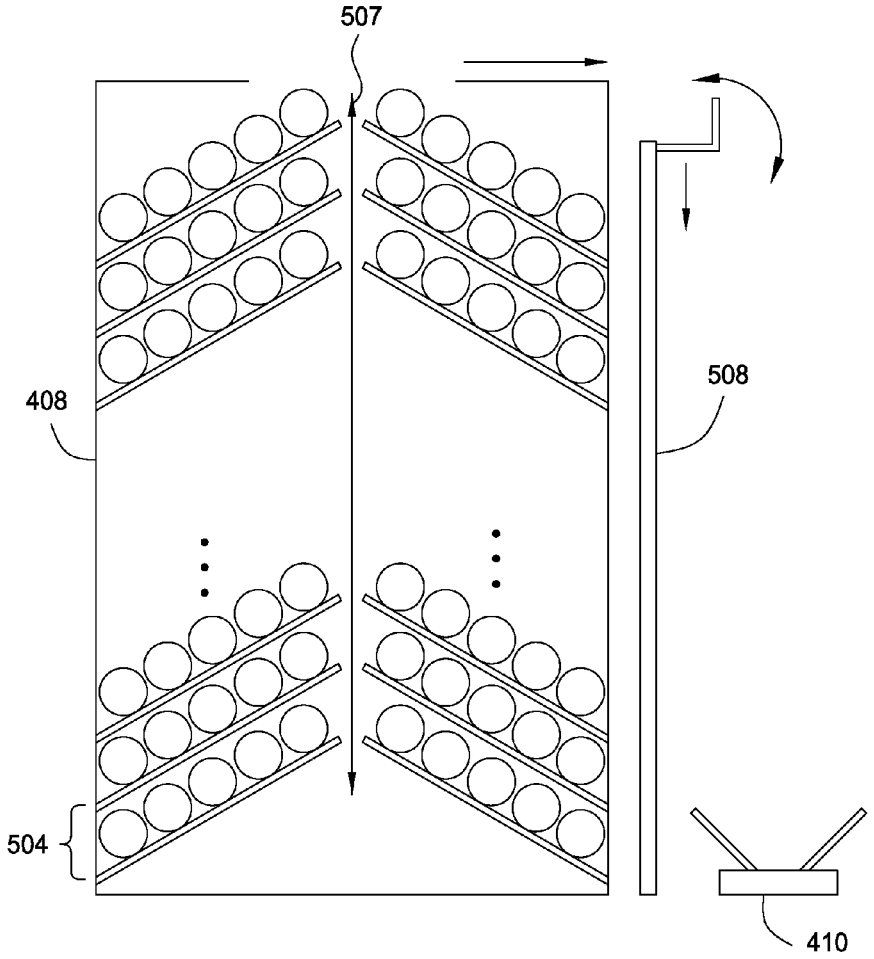

Another embodiment of the pipe handling system 408 is a complete horizontal pipe racking system installed on the grid 302 on the vessel 102, as illustrated, for example, in FIG. 5*c*. This pipe racking system may be loaded with pipe at the dockside, and feeds the elevator system 508 with single joints or stands of pipe. This pipe racking system may have a central elevator system 507 transferring joints or stands of pipe from the various pipe rack layers 504 to an upper or a lower pipe transfer system moving the pipe to the external elevator 508 and/or transfer system in line with the tubing make-up system 410. For some embodiments, the pipe handling system 408 may also have pipe racks located on either side of the pipe transfer system, which moves pipe to the tubing make-up system 410.

The pipe elevator system 508 may accept one by one joint or stand from the pipe staging area with an indexing system. The elevator system 508 may secure the pipe and lower it onto the pipe transfer system in line with the tubing make-up system 410. The pipe transfer system secures the pipe against sliding or rolling off the system during adverse movements of the vessel 102. The pipe handling system 408 may be split into two or more sections, allowing individual elevation adjustments of the handling system 408, e.g., when making up special assemblies.

Each roller support elevation may be adjusted to pipe size specific elevations by use of a remote control system, which may be located in a control room 416. The tubing make-up system 410 may comprise torque turn computers and make-up controls to cater to any pipe connection and/or pipe alloy. A gripping system for handling the pipe may be equipped with standard dies or MicroGrip® jaws and other gripping surfaces for the various pipe makeup requirements.

The tubing make-up system 410 may be configured to open to the side and to skid away from the pipe string in certain instances (e.g., after making up the tubing hanger or other special assemblies, and when running riser joints on the conveyor system to the slanted rig 104). The distance between head stock and tail stock may be adjustable, and the movement may be remote controlled, e.g., to bring the pin end into the box for the makeup process and to accommodate special assembly makeup distances/spread. The tubular may be handled with minimal human interaction or, ideally, no human interaction at all. Completion components such as safety valves, packers, control line, and tubing hangers may be deployed from tubing make-up system 410.

A blender and stimulation pump 412 may be found on the vessel 102 for use in stimulation treatments. The closed top blender may be a fairly standard 2×50 barrel (bbl) hydraulic stainless steel blender complete with a remote control console. The blender may mix a variety of chemicals including lost-circulation material (LCM). Each tub may be capable of holding a different chemical allowing two different LCM pills to be prepared. Typically, an LCM pill may be pumped into a well next to a loss zone in an effort to seal the formation into which circulation is lost. The dimensions of the blender may be similar to a 20 feet ISO container.

The stimulation pump 412 may be a standard 600 hydraulic horsepower (HHP) pump suitable for pressure testing up to about 10,000 psi and capable of displacing the chemicals from the blender into the tubing. The dimensions of this pump may be similar to a 20 feet ISO container, and there may be space on the vessel 102 for a larger pump with more HHP.

A second stimulation/mud pump 430 may be employed to provide the bulk of the circulation work with the regular stimulation pump 412 for pressure testing and as a back-up pump. The pump 430 may operate with up to about 1,000 HHP and be capable of rates up to approximately 10 barrels per minute (BPM). A third or larger capacity pump may also be provided. The dimensions of the pump 430 may be similar to a 20 feet ISO container.

As most of the equipment may be hydraulically powered, hydraulic power packs and generators 414 may be found on the vessel 102, wherein the system may be provided with 100% redundancy on the hydraulics. Two power packs, each fitted in a 20 feet ISO container, for example, may provide this hydraulic power with 100% redundancy. The system may also provide electric power generation with 100% redundancy. Two electric power generators may each be fitted in a 20 feet ISO container, for example.

The tension cable spools 428 may let out the tension cables 120 (e.g., Kevlar®-based tension cables) in a controlled manner. The spools 428 may be extraneous after the cables are deployed and may be positioned not to interfere with post-cable-deployment operations. Each spool may be designed to handle up to about 10,000 feet of cable. For some embodiments, the tension cable spools 428 may be in line with the tubing make-up system 410, allowing for horizontal movement along the rig 104 (i.e., a horizontal assembly line). With this horizontal assembly line, guiding systems need not route the pipe between the various systems (e.g., pipe handling system 408, tubing make-up system 410, rig 104, and the tension cable spools 428) on the deck 103. This may virtually eliminate alignment problems and reduce safety hazards on deck.

The surface/horizontal riser handler 426 may be utilized to handle the BHR 110 and the accompanying buoys 108. After deployment, the surface/horizontal riser handler 426 may be extraneous. Therefore, the riser handler 426 may be positioned on the deck 103 out of the way for subsequent operations.

The pipe handler/assistant 424 may be designed to allow for movement of pipe without suspending pipe on a cable. This may prevent uncontrolled motion due to movement of the vessel 102. The handler 424 may be remote controlled from a dedicated space in the control room 416. Depending on the choice of the pipe handling system 408 and the tubing make-up system 410, the pipe handler/assistant 424 may only be utilized during riser movement or possibly with special completion components. The overriding goal is to have a system that minimizes or preferably eliminates human contact with tubulars and completion equipment, thereby increasing safety aboard the vessel 102.

For some embodiments, operations of the rig 104 may be controlled and monitored in the control room 416. The umbilical spools 404 may also be controlled from the control room 416, but it may be more practical to provide primary or secondary control at the umbilical spools 404 themselves. A monitoring system in the control room 416 may continuously, periodically, and/or upon demand, record data including any combination of hydraulic pressure, BOP functionality, weight, heave, BHR loads, and/or umbilical pressure, and may also send data in real time to other locations.

There may be several dedicated areas on the deck 103 that may be intended for special functions, such as mounting flat packs and installing buoy connections. As illustrated in FIG. 4, the deepwater completion installation and intervention system may allow for flexibility, wherein the layout of the equipment may be changed, depending on the dimensions and layout of the deck 103 and the grid 302.

An Exemplary Deepwater Deployment Procedure

Following is an overview of a deployment procedure, in accordance with an embodiment of the present invention. With the vessel 102 on location (i.e., near the location of the wellhead 116), the horizontal derrick (i.e., horizontal/slanted rig 104) may be skidded aft. The tension cables 120 (e.g., Kevlar®-based tension cables) may be unwound from the tension cable spools 428 through the BTS 114. The rig 104 may be slanted to a 55° angle, for example, wherein the BTS 114 and the BOP stack 117 may be lowered by making up the BHR joints in the tubing make-up system 410. For some embodiments, the rig may be slanted in a range between 0 and 90° with respect to the deck 103. The BHR 110 may be landed on the emergency disconnect assembly on the rig 104. With the complete BHR 110 deployed, the buoys 108, 115 may be deflated/inflated to establish or adjust the shape of the BHR 110. Once the BHR 110 has reached sufficient length, the rig 104 may be slowly de-slanted (e.g., lowered) back to a horizontal level and operated at a complete or more nearly horizontal level (e.g., 0-3°) with respect to the deck 103 (or to the water surface), depending on the desired shape of the BHR 110.

Figure 6:
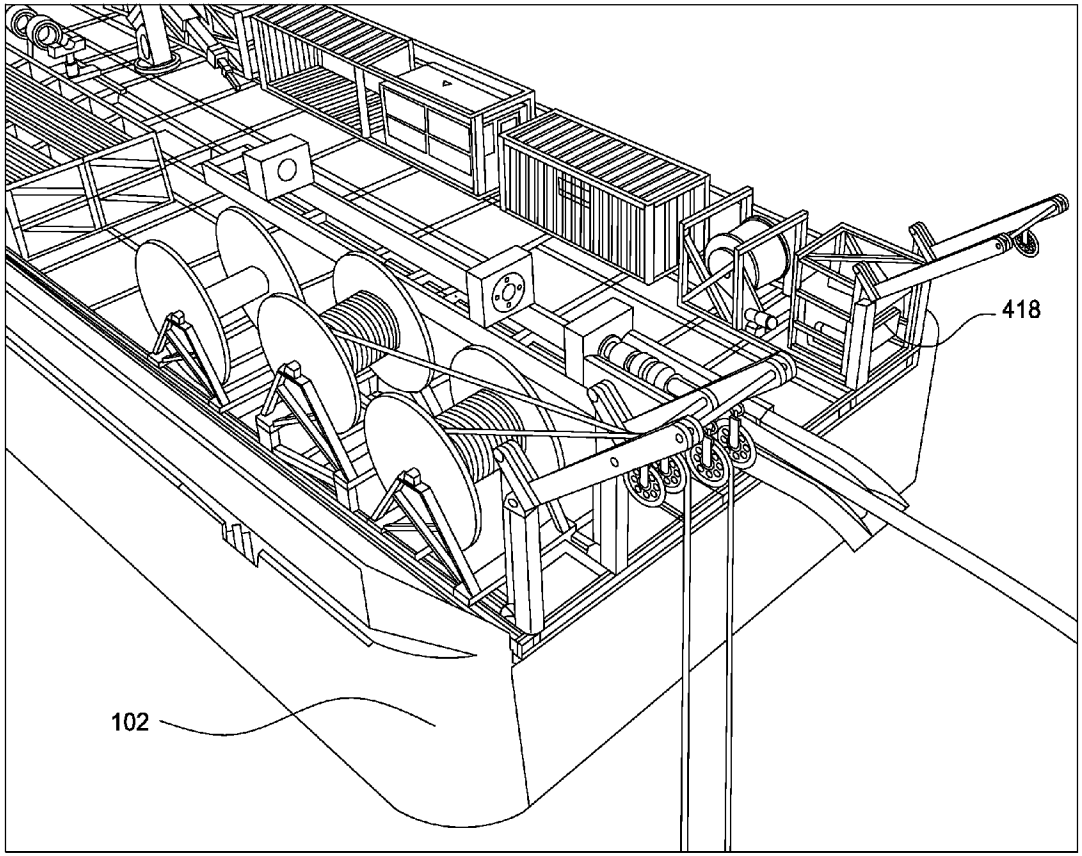
FIG. 6 illustrates the stern of the vessel after a buoyant tensioning system (BTS) is deployed, according to an embodiment of the present invention.

FIG. 6 illustrates the stern of the vessel 102 after the BTS 114 and the BOP stack 117 have been deployed from the vessel 102, in accordance with an embodiment of the present invention. A remotely operated vehicle 418 (ROV) may be deployed to prepare the wellhead 116 and/or support other subsea operations. For example, the tension cables 120 may be coupled to the wellhead 116 (e.g., via guideposts of the wellhead 116 or directly to the wellhead 116).

Figure 7:
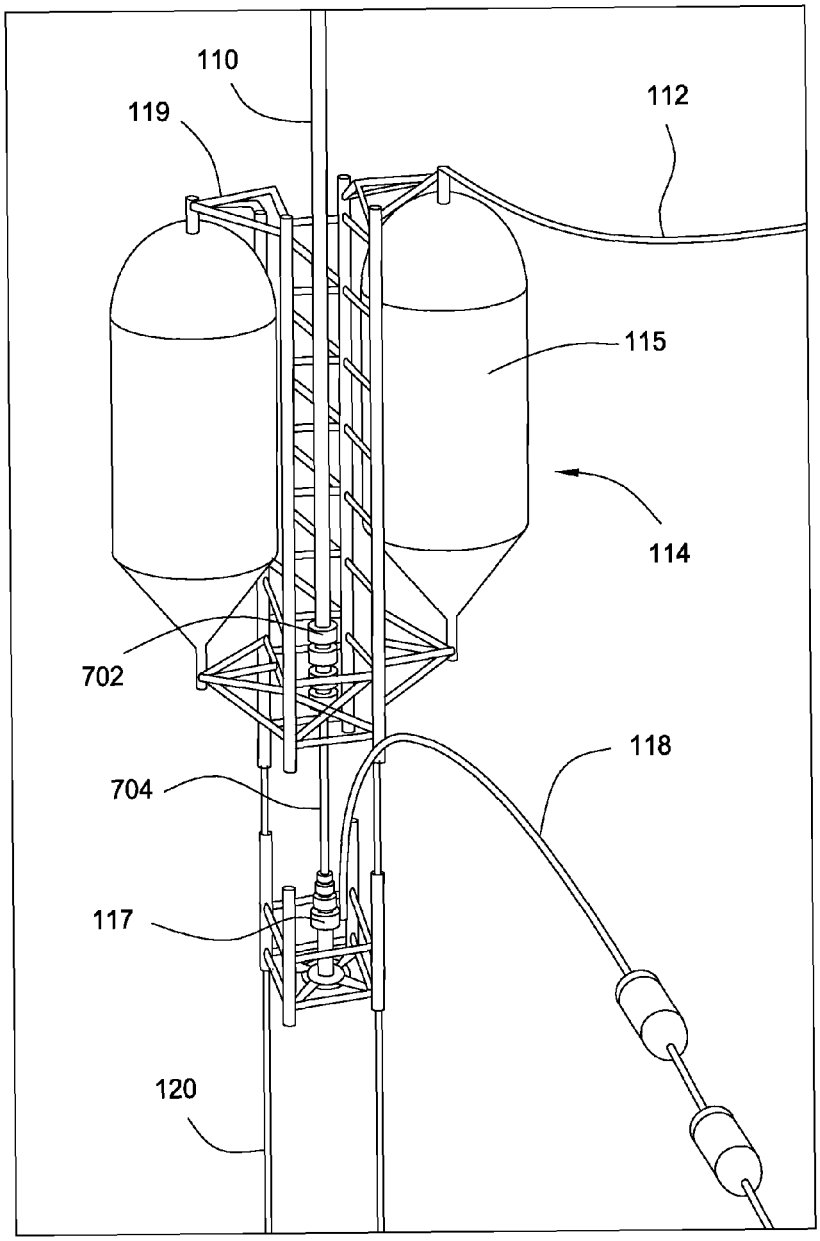
FIG. 7 illustrates the BTS with a blowout preventer (BOP) released and lowered towards a wellhead, according to an embodiment of the present invention.

The buoys 115 on the BTS 114 and/or the buoys 108 on the BHR 110 may be inflated to provide working buoyancy. FIG. 7 illustrates the BTS 114 with the buoys 115 inflated, in accordance with an embodiment of the present invention. Flex and/or swivel joints 702 may also be found on the BTS 114, for accommodating motion of the BHR 110. A landing string 704 may be run through the BHR 110, wherein the landing string 704 may latch to the BOP 117 and slowly lower the BOP 117 toward the wellhead 116. The BOP 117 may be coupled to the wellhead 116 such that umbilical connections may also be made, and desired system tests may then be performed. After the tests have been performed, the rig 104 may be ready to deploy the completion.

For wireline operations, a wireline tool may be transferred through the BHR 110 in various ways. For some embodiments, the tool may be pumped through the straight section 113 of the BHR 110. For other embodiments, the tool may be pushed through the straight section 113 of the BHR 110 with the aid of a push bar system. For still other embodiments, a tractor (e.g., an electric wire-controlled tractor) may be utilized to pull the wireline tool through the straight section 113 of the BHR 110 (and potentially a portion of the curved section 111), wherein the tractor may be removable and/or retractable. The weight of the wireline tool may then allow the tool to pass through a remaining portion of the curved section 111 of the BHR 110 via gravity.

For coiled tubing intervention, a similar, but much smaller BHR and BTS may be deployed, and instead of a conventional BOP, a coiled tubing BOP may be run under the BTS. After the BTS is deployed, a tubing string that has an outside diameter of, for example, 5.5 inches may be run through the BHR, wherein the tubing string may latch to the coiled tubing BOP and be lowered on top of the wellhead. The tubing string may be hung-off/suspended in the BTS. With the tubing string still attached, a horizontal coiled tubing injector head may be coupled to the tubing string on the vessel, and coiled tubing may be readily deployed. In essence, the tubing string may also function as a lubricator. When using this system, almost all possible coiled tubing and wireline type interventions may be possible and then may be combined with stimulation activities.

Figure 8:
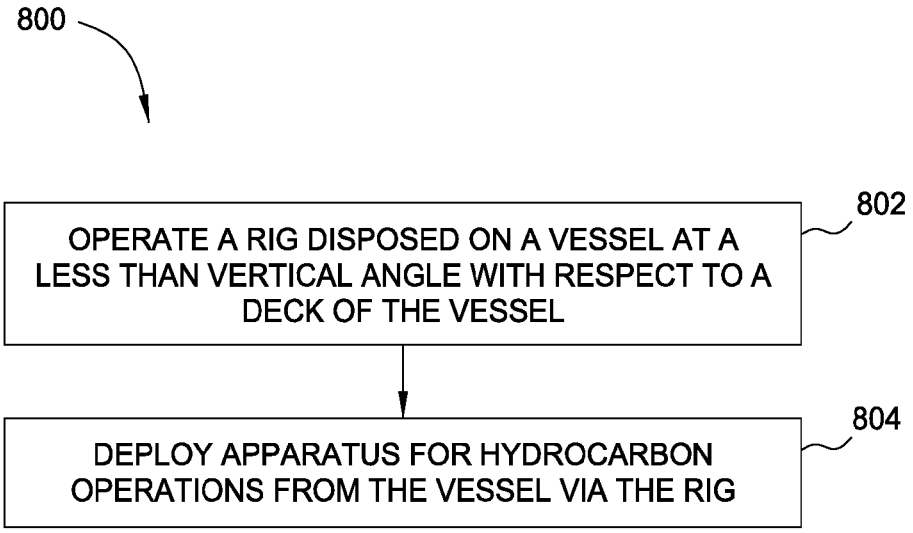
FIG. 8 is a flow diagram of exemplary operations for deploying components for hydrocarbon operations from a vessel, according to an embodiment of the present invention.

FIG. 8 is a flow diagram of exemplary operations 800 for deploying apparatus for subsea operations from a vessel (e.g., vessel 102). The operations 800 may begin, at 802, by operating a rig (e.g., rig 104) disposed on the vessel at a less than vertical angle with respect to a deck of the vessel. The rig may be slanted between 0 and 90° with respect to the deck (or the water surface). For some embodiments, the rig may be operated at a substantially horizontal angle with respect to the deck.

At 804, the apparatus may be deployed from the vessel via the rig. For some embodiments, deploying the apparatus at 804 may comprise deploying a buoyant tensioning system (BTS), such as the BTS 114 described above. The BTS may be used for deploying and retrieving subsea components from a wellhead. Furthermore, deploying the apparatus may comprise deploying a buoyant horizontal riser (BHR), such as the BHR 110 described above, which may be deployed after deploying the BTS for some embodiments. The BHR may be substantially horizontal at or near the rig disposed on the vessel. For some embodiments, deploying the BHR may comprise curving a portion of the BHR, such that the BHR is substantially vertical at or near the BTS. In order to curve this portion of the BHR, one or more buoys affixed to at least one of the BHR and the BTS may be inflated or deflated (i.e., the inflation of the buoys may be adjusted).

For some embodiments, deploying and retrieving the subsea components from the wellhead may comprise latching the BHR or a riser to one of the subsea components. To latch the riser to one of the subsea components, the riser may be run through the BHR from the vessel. Wireline, coiled tubing or other activities, such as well stimulation operations, may also be performed through the BHR for some embodiments.

While the foregoing is directed to embodiments of the present invention, other and further embodiments of the invention may be devised without departing from the basic scope thereof, and the scope thereof is determined by the claims that follow.

The invention claimed is:

1. A method of deploying, from a vessel, apparatus for hydrocarbon operations, comprising:

operating a rig disposed on the vessel at a substantially horizontal angle with respect to a deck of the vessel; and deploying the apparatus from a planar grid coupled to and disposed above the deck of the vessel via the rig at the substantially horizontal angle, the grid having one or more lengthwise beams and one or more crosswise beams intersecting the lengthwise beams, wherein before deploying the apparatus, at least some of the apparatus are routed through pre-existing holes in at least the lengthwise beams or the crosswise beams of the grid.

2. The method of claim 1, wherein deploying the apparatus comprises deploying a buoyant tensioning system (BTS), wherein the BTS is for deploying and retrieving subsea components from a wellhead.

3. The method of claim 2, wherein deploying the apparatus comprises deploying a buoyant horizontal riser (BHR) after deploying the BTS, wherein the BHR is substantially horizontal at or near the rig.

4. The method of claim 3, wherein deploying the BHR comprises curving a portion of the BHR, wherein the BHR is substantially vertical at or near the BTS.

5. The method of claim 4, wherein curving the portion of the BHR comprises inflating or deflating one or more buoys affixed to at least one of the BHR and the BTS.

6. The method of claim 3, wherein deploying and retrieving the subsea components from the wellhead comprises latching the BHR to one of the subsea components.

7. The method of claim 3, wherein deploying and retrieving the subsea components from the wellhead comprises latching a riser to one of the subsea components, wherein the riser is run through the BHR from the vessel.

8. The method of claim 3, further comprising performing wireline or coiled tubing operations through the BHR.

9. The method of claim 1, wherein the vessel comprises a non-dedicated vessel.

10. The method of claim 1, wherein the planar grid is parallel to the deck of the vessel.

11. A vessel, comprising:

a deck;

a planar grid coupled to and disposed above the deck, the grid having one or more lengthwise beams and one or more crosswise beams intersecting the lengthwise beams; and a rig configured to deploy apparatus for subsea hydrocarbon operations at a substantially horizontal angle with respect to the deck, wherein at least some of the apparatus are routed through pre-existing holes in at least the lengthwise beams or the crosswise beams of the grid before deployment.

12. The vessel of claim 11, wherein at least some of the apparatus are arranged on the grid in pre-designated locations and locked into place on the grid before deployment.

13. The vessel of claim 11, wherein the vessel is a non-dedicated vessel.

14. The vessel of claim 11, wherein the grid is laid out such that equipment associated with the rig is disposed in dedicated areas.

15. A system, comprising:

a vessel configured to deploy, from a planar grid coupled to and disposed above a deck of the vessel, apparatus for subsea hydrocarbon operations at a substantially horizontal angle with respect to the deck of the vessel, the grid having one or more lengthwise beams and one or more crosswise beams intersecting the lengthwise beams, wherein at least some of the apparatus are routed through pre-existing holes in at least the lengthwise beams or the crosswise beams of the grid before deployment;

a buoyant tensioning system (BTS) for coupling to a subsea wellhead; and a buoyant horizontal riser (BHR) coupled between the BTS and the vessel for routing the apparatus between the vessel and the wellhead.

16. The system of claim 15, wherein the BHR comprises a straight section.

17. The system of claim 16, wherein a curve of the BHR is controlled by one or more first buoys.

18. The system of claim 17, wherein the straight section of the BHR is supported by one or more second buoys.

19. The system of claim 18, wherein the second buoys are disposed under the straight section.

20. The system of claim 17, wherein the straight section of the BHR is supported by a tension cable coupled to a mast on the vessel.

21. The system of claim 15, further comprising a cable or a riser for coupling the BTS to the wellhead.

22. The system of claim 21, wherein the BTS comprises a frame that is connected with the cable or the riser.

23. The system of claim 15, wherein the vessel is a non-dedicated vessel.

24. The system of claim 15, wherein at least some of the apparatus are arranged on the grid in pre-designated locations and locked into place on the grid before deployment.

25. The system of claim 15, wherein the grid is laid out to accommodate, in dedicated areas, different types of components for making up or deploying the apparatus for subsea hydrocarbon operations.

* * * * *